United States Patent [19]

Moorman

[11] 3,992,878

[45] Nov. 23, 1976

[54] ENGINE SECONDARY AIR FLOW CONTROL SYSTEM

[75] Inventor: James W. Moorman, Inkster, Mich.

[73] Assignee: Ford Motor Company, Dearborn, Mich.

[22] Filed: Oct. 3, 1975

[21] Appl. No.: 619,341

[52] U.S. Cl. ..... 60/278; 60/290; 123/119 A

[51] Int. Cl.[2] ..... F02B 75/10

[58] Field of Search ..... 60/290, 278, 289; 123/119 A

[56] References Cited

UNITED STATES PATENTS

| | | | |
|---|---|---|---|
| 3,828,746 | 8/1974 | Martelaere | 123/119 A |
| 3,888,080 | 6/1975 | Nohira | 60/290 |
| 3,905,193 | 9/1975 | Heilman | 60/290 |
| 3,906,723 | 9/1975 | Matumoto | 60/290 |

*Primary Examiner*—Douglas Hart
*Attorney, Agent, or Firm*—Robert E. McCollum; Keith L. Zerschling

[57] ABSTRACT

An engine has an air injection system injecting air into the exhaust system to reduce emissions. The injection is scheduled by a bypass valve that normally permits injection, but bypasses or dumps the air as a function of a carburetor ported vacuum signal that is also used to control exhaust gas recirculation. A control is provided to maintain air injection for a short period during certain engine idle conditions, but dumping of the air after this period. An engine deceleration override is provided to dump the air when this condition exists, to prevent backfire. A cold engine vacuum lock-out also is provided.

12 Claims, 1 Drawing Figure

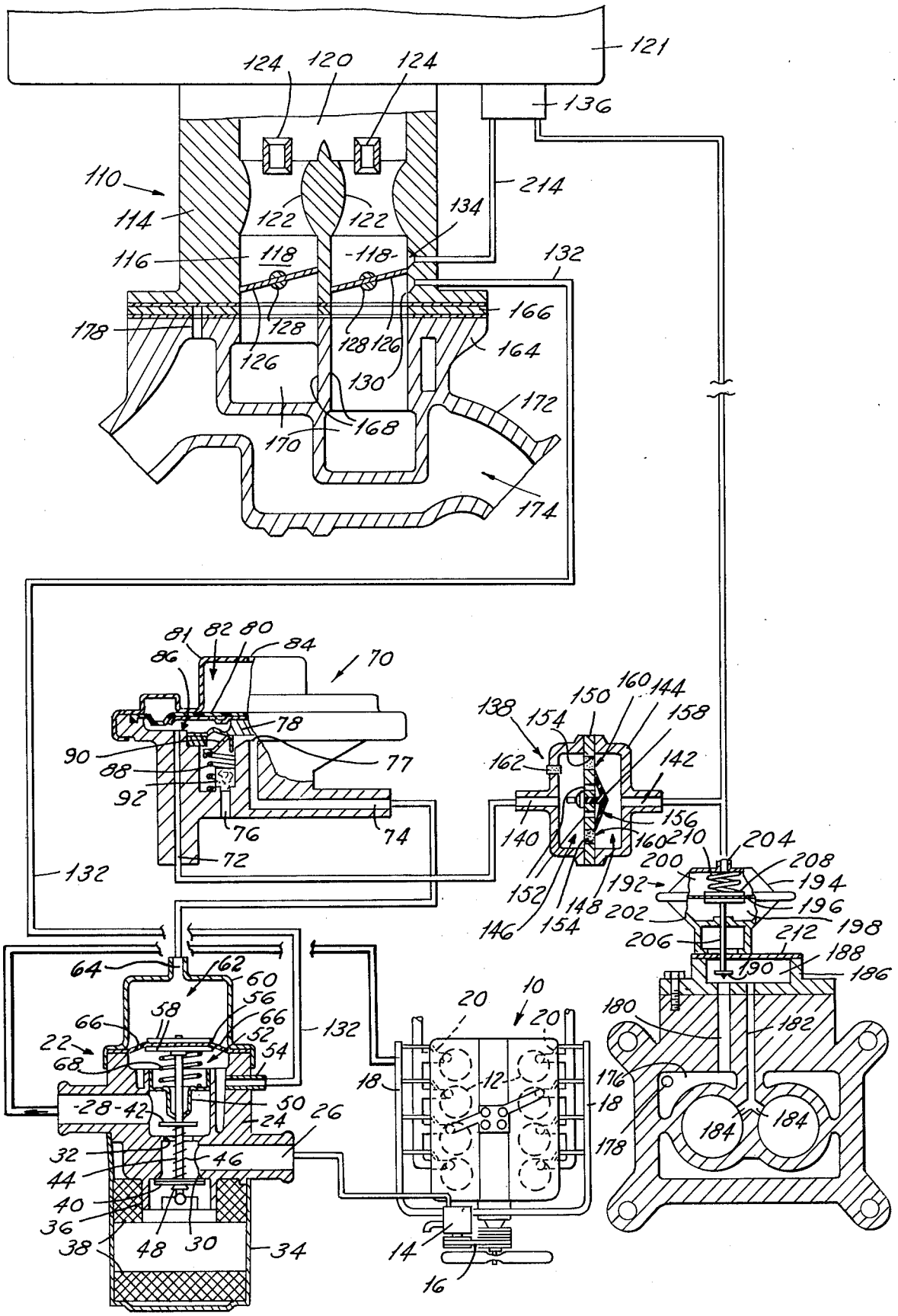
121
124
120
124
136
110
214
114
122
122
134
116
118
118
132
166
178
128
128
126
126
164
130
172
168
170
174
81
82
80
84
86
70
78
90
88
77
92
76
74
72
132
138
154
150
160
144
158
162
142
156
140
160
210
204
200
208
192
194
152
148
202
196
146
154
198
206
212
188
190
186
64
62
60
58
56
66
66
52
132
22
68
54
-28-42
50
24
26
32
46
44
40
36
38
48
30
34
20
10
20
18
12
18
180
182
176
178
184
184
14
16

ENGINE SECONDARY AIR FLOW CONTROL SYSTEM

This invention relates in general to a motor vehicle type internal combustion engine. More particularly, it relates to a system for controlling air flow through the air injection system of an internal combustion engine.

Many motor vehicle type engines are equipped with secondary air injection systems for injecting air into the engine exhaust system to reduce emissions. Some systems also include catalytic converters for reducing emissions. It is quite important, therefore, to control accurately the flow of secondary air to prevent an overtemperature condition of the converter. Accordingly, it is important to provide a schedule so that the secondary air will flow into the exhaust system or be dumped into the atmosphere, in accordance with engine operations, to prevent backfire, to prevent overtemperaturing of the converter during prolonged engine idle speed conditions, to provide cold catalyst protection, and to provide cold engine exhaust gas recirculation control.

It is a primary object of the invention, therefore, to provide an air flow control system for the air injection system of an internal combustion engine to automatically control the bypassing of the air output of the air pump in accordance with engine operating conditions.

It is another object of the invention to provide an air flow control system of the type described above that includes an air bypass valve at the discharge end of an air pump driven by the engine, the bypass valve normally delivering air to the engine exhaust system for emission control purposes, and operating to bypass the air from the exhaust system in response to a carburetor ported manifold vacuum signal varying as a function of the position of the carburetor throttle valve and operable during engine part throttle operation to permit normal delivery of the air to the exhaust system, and including a vacuum delay valve that is operable at times during engine idle speed operation to delay bypassing of the air for a predetermined period, an override being provided to permit immediate dumping of the air during engine deceleration operation to prevent overtemperaturing of a catalytic converter, the system also including a connection to the exhaust gas recirculating valve to be operable by the ported manifold vacuum signal so that during idle conditions the EGR valve is rendered inoperative.

It is another object of the invention to provide a a temperature control for the air flow control system described above that renders the above system inoperative below predetermined temperature levels and causes automatic dumping or bypassing of the air output of the engine air pump.

Other objects, features and advantages of the invention will become more apparent upon reference to the succeeding detailed description thereof, and to the drawing wherein the figure schematically illustrates a preferred embodiment thereof.

FIG. 1 shows a system used to control the emission of undesirable elements into the atmosphere from an internal combustion engine. More specifically, it shows a plan view of a conventional V-8 internal combustion engine 10 having right and left banks of cylinders each with exhaust ports 12. Also shown is an air injection system consisting of an air pump 14 driven by the engine through a belt 16. The pump delivers so called secondary air to a catalytic converter, not shown, as well as to each exhaust port through manifolding 18 and injectors 20. The air lowers $NO_x$ formation and combines with the unburned hydrocarbons and carbon monoxide that pass into the exhaust system to reduce them to $H_2O$ and $CO_2$.

To protect the catalytic converter and also other portions of the engine, an air bypass valve 22 is provided that automatically schedules the flow of secondary air in passage 18. That is, the valve 22 is constructed to normally permit the flow of secondary air through passage 18 to the converter except during certain engine operating conditions that, for example, might damage the converter. At these times, the valve will be moved to a bypass position diverting or dumping the air pump output to the atmosphere.

More specifically, the bypass valve is shown as including a valve body 24 having air inlet and outlet openings 26 and 28 offset with respect to each other to form a number of vertically aligned ports 30 and 32. The lower port 30 is connected directly to the atmosphere through a hole 34 in a lower housing portion 36 that mounts a filter 38. A pair of spaced valve plates 40 and 42 are loosely mounted on a valve stem 44 for alternate seating against the valve ports 30 and 32. A spring 46 lightly biases the valve plates apart and against a stop 48 at one end and against a cup-shaped spacer and spring retainer 50 at the other end. The spacer seals the air outlet section from a vacuum chamber 52 connected to engine intake manifold vacuum through an inlet 54.

The upper end of valve stem 44 is fixed to an annular flexible diaphragm 56 by a pair of retainers 58. The diaphragm is edge mounted against the upper part of the valve body by a cover member 60 to define a chamber 62. The latter chamber has a vent outlet 64 adapted either to be blocked or vented to atmosphere. The diaphragm 56 and retainers 58 contain a pair of controlled area bleed holes 66 that permit the slow equalization of pressures to opposite sides of the diaphragm when vent outlet 64 is blocked. This permits a spring 68 housed in cup 50 to bias the diaphragm upwardly to seat valve plate 40 and unseat valve plate 42. This permits the normal discharge of air from air pump 10 through inlet 26 past valve plate 42 into outlet 28.

The lower valve plate acts as a pressure relief valve as well as a dump valve outlet, and opens automatically when air pump backpressure exceeds the value of spring 68 and the forces acting on diaphragm 56. The valve plate 40 also opens when outlet 64 is connected to atmospheric pressure, since then the pressure in chamber 62 is always higher than any forces in the opposite direction.

The operability of bypass valve 22 as determined by the blocking or venting of outlet 64 is controlled by a valve 70 whose movement in turn is controlled by carburetor ported manifold vacuum. More spcifically, valve 70 consists of a valve body provided with a vacuum signal passage 72, a control passage 74 connected to bypass valve vent 64, and an atmospheric vent passage 76. The upper end of control passage 74 is conically-shaped to form a valve seat 77 for a valve member 78. The latter is secured to an annular flexible diaphragm 80 sealingly secured between the top of the valve body and a cover 81. The cover forms an air chamber 82 with the diaphragm, communicating with the atmosphere through a vent 84. A recess between the valve body and diaphragm forms a second chamber 86 connected to vacuum signal passage 72. A spring 88 biases an actuator 90 against valve 78 urging it off the seat 77 to connect air in passage 76 past a filter 92 to air bypass valve passage 74.

The signal vacuum in passage 72 emanates from a carburetor induction passage port located above the closed position of the conventional throttle valve. More specifically, the upper portion of the figure shows a cross section of a portion 110 of one-half of a four barrel caburetor of a known downdraft type. It has an air horn section 112, a main body portion 114, and a throttle body 116, joined by suitable means not shown. The carburetor has the usual air/fuel induction passages 118 open at their upper ends 120 to fresh air from the conventional air cleaner, illustrated schematically at 121. The passages 118 have the usual fixed area venturii 122 cooperating with boost venturii 124 through which the main supply of fuel is induced, by means not shown. Flow of air and fuel through induction passages 118 is controlled by a pair of throttle valve plates 126 each fixed on a shaft 128 rotatably mounted in the side walls of the carburetor body.

The carburetor induction passage had a manifold vacuum sensing port 130 connected by a line 132 to the bypass valve vacuum signal line 54. The induction passage also contains an exhaust gas recirculating (EGR) port 134 that is located above port 130 and above the closed position of throttle valve 126 so that it is traversed by the edge of the throttle valve as it moves open. The pressure in port 134 thereby varies from atmospheric to the manifold vacuum level as a function of the opening of throttle valve 128.

Port 134 is connected to passage 72 and valve 70 by way of a temperature sensitive switch 136. The latter is located in the air cleaner 121 and may consist simply of a known type of open-close flow switch that closes below a predetermined temperature of the air in the air cleaner. When closed, vacuum in port 134 will be blocked from communicating with line 72 while line 72 will be vented to atmosphere through the switch 136.

Delivery of secondary air to the exhaust ports is desirable during engine idle conditions to reduce emissions. However, prolonged idle conditions may cause an overheating condition that could cause a malfunction of the catalytic converter. A vacuum delay valve 138, therefore, is inserted in line 72 to delay dumping of the secondary air for a predetermined period of, say, 1–2 minutes, for example, after the engine is conditioned for idle speed operation. The valve may be of a known design having a connection 140 at one end to line 72 and a connection 142 at the opposite end to carburetor port 134. Housing 144 is divided into two chambers 146, 148, by an annular partition 150 having a number of radially spaced sets of circumferentially spaced apertures 152 and 154. The apertures 152 are adapted to be controlled by a flexible one-way check valve 156.

Check valve 156 consists of a flapper or umbrella-type seal having a flexible membrane 158 secured on an axial stem. The stem projects through a central bore in partition 150, and is fixed therein, as shown, by means of spaced shoulders or flanges. Membrane 158 is responsive to the differential in pressures on opposite sides thereof to alternately move to an open or closed position. When the pressure level in the chamber 148 is greater than in the left hand chamber 146, the valve will close, and the decay of vacuum in chamber 146 can occur only slowly through holes 154. In the open position, the membrane 158 is flexed outwardly when the pressure level in 146 is greater than in chamber 148, to permit a free communication between chambers through holes 152.

Holes 154 contain sintered metal plugs 160 that each consist of randomly oriented and dispersed multitudes of minute metal particles compacted together under pressure into discs and passed through a furnace to bond the particles to each other. This defines a multitude of labyrinthian-type fluid passages connecting the voids between particles, and provides an extremely close tolerance flow restrictor or orifice. The particles may be balls, or free-shaped bent plate particles, for example. Their size will control the flow restriction and delay time. The sintered metal plugs, therefore, constitute a flow restricting means that delays the communication between opposite sides of partition member 150 when the check valve 156 is closed.

The wall of housing 144 contains an atmospheric or ambient pressure air bleed consisting of a sintered metal plug 162. The latter is similar in construction to plugs 160, but of a larger flow area; i.e. less restriction. The air bleed assures a flow through the line at all times, when the throttle valves 126 are open, in a direction from the chamber 146 to port 134, to prevent fuel leakage from the carburetor into line 72 and contaminating the check valve 158.

The carburetor vacuum port 134 also is adapted to control the recirculation of exhaust gases (EGR) back into the engine to reduce $NO_x$ formation.

More specifically, the carburetor throttle body 116 is flanged as indicated for bolting to the top of the engine intake manifold 164, with a spacer element 166 located between. Manifold 164 has a number of vertical risers or bores 168 that are aligned for cooperation with the discharge end of the carburetor induction passages 118. The risers 168 extend at right angles at their lower ends 170 for passage of the mixture out of the plane of the figure to the intake valves of the engine.

The exhaust manifolding part of the engine cylinder head is indicated partially at 172, and includes an exhaust gas crossover passage 174. The latter passes from the exhaust manifold, not shown, on one side of the engine to the opposite side beneath the manifold trucks 170 to provide the usual "hot spot" beneath the carburetor to better vaporize the air/fuel mixture.

The spacer 166 is provided with a worm-like recess 176 that is connected directly to crossover passage 174 by a bore 178. Also connected to passage 174 is a passage 180 alternately blocked or connected to a central bore or passage 182 communicating with risers 168 through a pair of ports 184. mounted to one side of the spacer is a cup-shaped boss 186 forming a chamber 188 through which passages 180 and 182 are interconnected.

Passage 180 normally is closed by an (EGR) valve 190 that is moved to an open position by a servo 192. The servo includes a hollow outer shell 194 containing an annular flexible diaphragm 196. The latter divides the interior into an air chamber 198 and a signal vacuum chamber 200. Chamber 198 is connected to atmospheric pressure through a vent 202, while chamber 200 is connected to the carburetor vacuum signal port 134 (EGR port) through line 204. The stem 206 of valve 190 is fixed to a pair of retainers 208 secured to diaphragm 196. They serve as a seat for a compression spring 210 normally biasing the valve 190 to its closed position. The stem 206 slidably and sealingly projects through a plate 212 closing chamber 188.

The overall operation of the invention is as follows. Below an air cleaner temperature level of say, 60° F., for example, the switch 136 will be closed to block the communication of vacuum from the EGR port 134 to any other part of the system described. Accordingly, there will be no vacuum in the line 204 to the EGR valve servo 192, causing the EGR valve 190 to remain closed, and there will be no vacuum in the line 72 to valve 70. This will result in the spring 88 of valve 70 moving the diaphragm 80 to bleed the line 74 connected to the bypass valve vent 64. Atmospheric pressure acting in the bypass valve chamber 62 on diaphragm 56, therefore, is sufficient to move the bypass valve to a dump or diverting position opening the lower valve 40 and closing the upper valve 42. As a result, all the output from air pump 10 will pass into inlet 26 but out into the atmosphere past the open valve 40 and the filter 38 through the opening 34. As a result, the catalytic converter temperature will be held essentially at ambient conditions.

Above a 60° F temperature setting, the air cleaner temperature switch 136 will open permitting communication of vacuum between the EGR port 134 and the respective lines 204 and 72 to the EGR valve servo 192 and control valve 70. More specifically, assume an engine idle speed condition with closed throttle valves 128. With the EGR port 134 being located above the edge of the closed throttle valve, atmospheric pressure will exist in the lines 214, 204 and 72. Therefore, the same conditions will prevail as when the temperature level in the air cleaner is below 60° F. All of the output from the air pump will be bypassed.

Assume now that the throttle valves have been depressed to traverse the EGR port 134 and subject the EGR port to the manifold vacuum. This vacuum will first be communicated to the EGR valve servo 192, and if of a level sufficient to overcome spring 210 will open the valve 190 in proportion to the valve of the manifold vacuum level to recirculate the exhaust gases in a desired manner. Also, vacuum communicated to port 142 will open the check 156 in the vacuum delay valve unit 138 to immediately equalize the vacuum levels in chambers 146 and 148. This vacuum then is communicated to the control valve 70 to act on the diaphragm 80 and close or block the passage 74. This in effect makes chamber 62 of the bypass valve unit 22 a quiescent chamber, permitting the atmospheric pressure in chamber 62 to be bled to the level of the vacuum in tube 54 through the bleed holes 66. As soon as equalization of pressures occurs, the force of main spring 68 will move the bypass valve to the position shown closing the plate valve 40 and permitting the normal delivery of air from the air pump through the inlet 26 past the open plate valve 42 to the outlet 28. The exhaust ports and catalytic converter then will be supplied with additional or secondary air to reduce emission output.

Assume now that the throttle valve is returned towards or to an engine idle speed position, but without necessarily an engine deceleration condition occurring. The first thing that happens is that the vacuum port 134 now senses less vacuum or even atmospheric pressure. Immediately, this will close the EGR valve 190 and will close the check valve 156 of the vacuum delay valve. Since, as stated before, continued emission control for short periods is desired during engine idle speed operation, the closing of the check valve 156 maintains the vacuum in line 72 to the control valve 70. Accordingly, the passage 74 remains blocked and the bypass valve

22 remains in a non-bypass or inoperable position delivering air from the air pump 10 to the catalytic converter and exhaust ports.

After a predetermined period of, say, 1–2 minutes, for example, the communication of atmospheric pressure through the sintered metal orifices 154 in the vacuum delay valve 138 will have decayed the vacuum signal in line 72 to a level permitting the spring 88 of control valve 70 to move the diaphragm 80 up and vent the line 74 to an atmospheric pressure. This immediately causes the bypass valve to become operable and the diaphragm 56 to move downwardly to open the valve 40 while closing the valve 42, and thereby dump all of the output from air pump 26 to the atmosphere through opening 34. This action thus provides emission control for a short period of engine idling conditions while preventing overtemperaturing of the catalytic converter and other parts upon prolonged engine idle conditions.

The system also provides an override of the secondary air injection system during engine deceleration operations. That is, if during a cruising operation, for example, with the throttle valves open, the operator removes his foot from the accelerator pedal, the throttle valve will be returned to an idle speed closed condition. At this time, the driving of the engine by the vehicle may cause the vacuum levels to approach deceleration levels of 19–21 inches Hg., for example. At these levels, the large amount of idle system fuel and air inducted into the system may cause backfire conditions to occur. To offset this, when deceleration conditions occur, the higher vacuum level acting in manifold vacuum line 54 at the bypass valve 22 will be sufficiently greater than the vacuum level in chamber 62 to overcome the force of spring 68 and immediately move the diaphragm 56 and valve 42 downwardly to the dump position to divert all air from the air pump through the outlet 34, thus reducing the backfire problems.

From the above, therefore, it will seen that the invention provides backfire control, full-time idle air control cold temperature catalyst protection, and cold (EGR) lock-out, all obtained mechanically without the use of electric solonoids, or other more complicated costly apparatus.

While the invention has been shown and described in its preferred embodiment, it will be clear to those skilled in the arts to which it pertains that many changes and modifications may be made thereto without departing from the scope of the invention.

I claim:

1. An airflow control system for an internal combustion engine having an engine driven air pump with a discharge outlet delivering air to the engine, a selectively operable air bypass valve associated with the outlet when operable movable to a dump position diverting air from the outlet, the valve being rendered operable in response to engine manifold vacuum acting thereon at engine deceleration vacuum levels, the engine having a carburetor providing a throttle valve ported vacuum signal varying from an atmospheric pressure level to manifold vacuum levels as a function of the opening movement of the throttle valve from a closed position, control means responsive to a ported vacuum signal above a predetermined vacuum force level to render the bypass valve inoperable and responsive to a vacuum signal below the predetermined level to render the bypass valve operable, and vacuum delay means associated with the control means for delaying the rendering of the bypass valve operable upon a decrease in the vacuum signal force level from above to below the predetermined level and below the deceleration level.

2. An airflow control system as in claim 1, including an exhaust gas recirculating (EGR) passage, a selectively operable (EGR) valve normally inoperable and blocking the (EGR) passage preventing flow of exhaust gases through the passage, the (EGR) valve being rendered operable in response to a ported vacuum signal acting thereon above a second predetermined level, whereby decrease in the level of the ported vacuum signal sufficient to render the bypass valve operable renders the (EGR) valve inoperable.

3. An air flow control system as in claim 1, including temperature responsive means connecting the ported vacuum signal to the control means above a predetermined temperature level and blocking the connection of the ported vacuum signal to the control means below the predetermined temperature level to render the bypass valve operable at all times below the predetermined temperature level.

4. An air flow control system as in claim 1, including a fluid pressure actuated piston means connected to the bypass valve for moving the bypass valve, spring means biasing the piston means to a bypass valve inoperable position, means operably connecting manifold vacuum to opposite sides of the piston means in a force balancing manner permitting the spring means to position the bypass valve, the control means including an air vent connected to the side of the piston means in force opposition to the spring means to subject this side of the piston means to atmospheric pressure to move the bypass valve to a dump position, the control means also including air vent blockage means movable in response to the ported vacuum signal above the predetermined vacuum force level to block the air vent and permit operation of the bypass valve under the control of the spring means and manifold vacuum.

5. An air flow control system as in claim 4, the vacuum delay means being insertable in a conduit connecting the carburetor ported vacuum signal to the control means, and including a slow rate flow restrictor and a vacuum bypass valve, the vacuum bypass valve being operable in response to a higher vacuum on the caburetor side of the delay means than on the control means side to bypass the restrictor and immediately equalize the pressure on the two sides of the delay means.

6. An air flow control system as in claim 5, the control means including a control piston movable to block or unblock the air vent, and means connecting the conduit to the control piston to control movement of the control piston as a function of the change in the ported vacuum signal.

7. An air flow control system as in claim 6, including temperature responsive means in the conduit means between the carburetor and delay means and movable in response to a decrease in the temperature level below a predetermined level from a first position opening the conduit to a second position blocking flow of ported vacuum signal from the carburetor.

8. An air flow control system as in claim 2, including temperature responsive means in conduit means connecting the carburetor and delay means and movable in response to a decrease in the temperature level below a predetermined level from a first position opening the conduit to a second position blocking flow of ported vacuum signal from the carburetor.

9. An air flow control system as in claim 8, the temperature responsive means also being located between the carburetor and the (EGR) valve.

10. An air flow control system as in claim 7, including an air cleaner assembly located over the air inlet to the carburetor, the temperature responsive means being located adjacent the air cleaner to be sensitive to the air cleaner air temperature.

11. An air flow control system for an internal combustion engine having an air pump with an air discharge line connected to the pump and to the exhaust system of the engine, an air bypass valve in the line movable between a first open position connecting the air from the air pump to the line and a second dump position diverting the air from the line, spring means biasing the valve to the first open position, piston means connected to the valve to move the valve between the positions, means operably connecting engine manifold vacuum to act on one side of the piston in opposition to the spring means to move the valve to the dump position above a predetermined vacuum level, bleed means connecting manifold vacuum from one side to the other side of the piston to permit equalization of the vacuum levels and resultant movement of the valve to the open position by the spring means, a vent line connected to the other side of the piston for at times venting the other side and subjecting the piston to atmospheric pressure to move the valve to the dump position, valve means in the vent line movable between a blocking position blocking the vent line and a second open position opening the vent line, a carburetor having an induction passage open at one end and connected to the intake manifold at the other end, a throttle valve rotatably mounted for movement across the passage between closed and open passage positions, a pressure port in the passage located above the closed throttle valve position and adapted to be traversed by the edge of the throttle valve in its opening movement to progressively subject the port to manifold vacuum, and conduit means connecting the port to the valve means for actuating the valve means to a vent line blocking position in response to port vacuum above a predetermined level acting on the valve means, the conduit means including a one-way flow restrictor delaying the communication of an increase in the pressure level at the port to the valve means whereby opening of the throttle valve subjects the valve means to a vacuum force to effect blocking of the vent line and opening of the air bypass valve, the bypass valve remaining opened upon closure of the throttle valve so long as the flow restriction is effective to delay the decay of vacuum to the valve means and the vacuum level remains below the engine deceleration predetermined level sufficient to permit manifold vacuum acting on the bypass valve piston to move the bypass valve to the dump position.

12. An air flow control system as in claim 11, including an exhaust gas recirculating (EGR) passage, a selectively operable (EGR) valve normally inoperable and blocking the (EGR) passage preventing flow of exhaust gases through the passage, the (EGR) valve being rendered operable in response to a ported vacuum signal acting thereon above a second predetermined level, whereby decrease in the level of the ported vacuum signal sufficient to render the bypass valve operable renders the (EGR) valve inoperable.

* * * * *